United States Patent [19]

Hutzell

[11] 4,361,197

[45] Nov. 30, 1982

[54] BLAST HOLE GROOVING BIT AND WEAR RESISTANT COMPACT

[75] Inventor: Clyde H. Hutzell, Schellsburg, Pa.

[73] Assignee: Kennametal Inc., Latrobe, Pa.

[21] Appl. No.: 190,194

[22] Filed: Sep. 24, 1980

[51] Int. Cl.[3] ..... E21B 10/40

[52] U.S. Cl. ..... 175/407; 175/389

[58] Field of Search ..... 175/389, 407, 416, 419, 175/390

[56] References Cited

U.S. PATENT DOCUMENTS

| | | | |
|---|---|---|---|
| 629,145 | 7/1899 | Alnon | 175/407 |
| 740,906 | 10/1903 | Owen | 175/389 |
| 1,514,156 | 11/1924 | Hancock | 175/407 X |
| 1,631,693 | 6/1927 | Richey | 175/407 |
| 1,941,217 | 12/1933 | McKinless | 175/407 X |
| 2,602,640 | 7/1952 | Colley | 175/407 X |
| 2,759,705 | 8/1956 | Björkman | 175/419 |
| 3,277,973 | 10/1966 | Eberman | 175/407 |

OTHER PUBLICATIONS

"Field Evaluation of Fracture Control in Tunnel Blasting" Dec. 1979, NTIS, PB80-149297.

*Primary Examiner*—William F. Pate, III
*Attorney, Agent, or Firm*—Lawrence R. Burns

[57] ABSTRACT

A blast hole drill bit is disclosed for forming longitudinally extending grooves in already drilled blast holes, having a body with a forward face and a rearwardly extending pilot diameter. One or more radially extending wings are located at the rearmost part of the pilot diameter and are V-shaped when viewed in plan. Wear resistant compacts form a part of the wings and have a V-shaped cutting edge.

19 Claims, 9 Drawing Figures

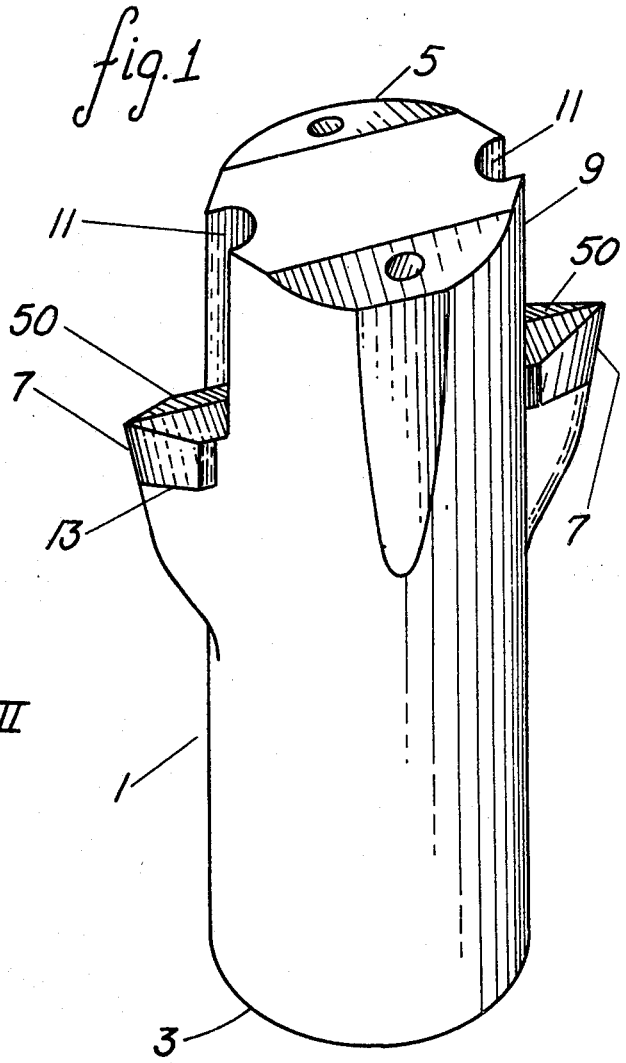
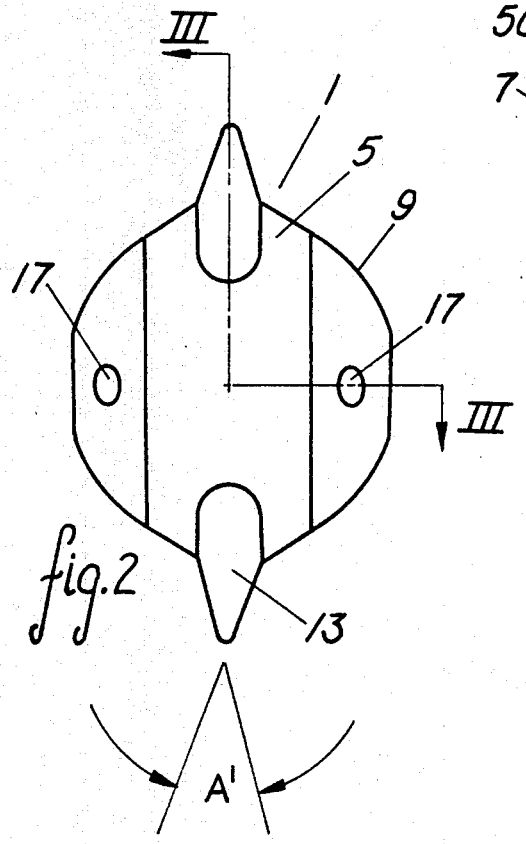
fig.2
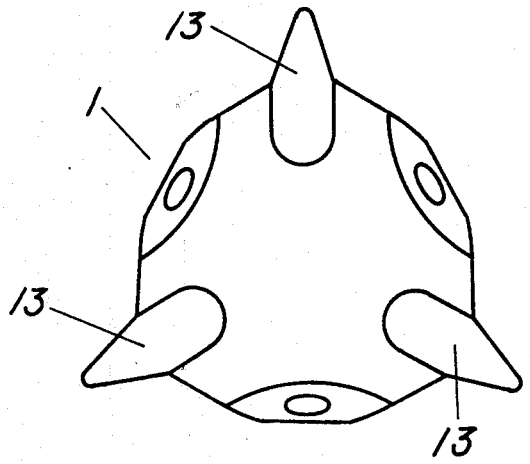
fig.3

BLAST HOLE GROOVING BIT AND WEAR RESISTANT COMPACT

BACKGROUND OF THE INVENTION

This invention concerns blast hole drill bits and is especially concerned with a bit for forming longitudinal grooves in already drilled blast holes.

A study conducted for the United States Department of Transportation has concluded that longitudinal V-notches or grooves formed along the peripheral surfaces of predrilled blast holes aids in the control of crack propagation during blasting of the bore hole.

The study, entitled "Field Evaluation of Fracture Control in Tunnel Blasting," (Report No. UMTA-MA-06-0100-79-14) determined the effect of groove geometry on the crack initiation phase of controlled fracture. The study indicates that grooved blast holes may be a more efficient alternative to conventional drill and blast procedures. The notched holes require significantly less explosives to achieve the same results as fully charged conventional holes. This results in lower blast noise levels and less vibration. This is very beneficial, particularly in highly populated areas.

Conventional drill bits for drilling blast holes usually are comprised of a bit body having a forward working face. The forward working face has wear resistant compacts of the button, log cabin or other configuration, embedded therein and protruding out of the working face.

Tools for forming grooves in roof bolt holes are also known, such as shown and described in U.S. Pat. No. 3,960,222, granted to applicant corporation. Such tools do not readily lend themselves to forming longitudinal grooves in rock formations in which blast holes are drilled.

The cutting elements used in the referenced patent and in U.S. Pat. No. 2,879,973, also granted to applicant corporation, which discloses a percussion drill bit, are not designed to form a V-notch in the wall of a blast hole. U.S. Pat. No. 3,191,700, granted to applicant corporation, discloses a rotary percussion drill bit having cemented carbide cutting inserts with a V-shaped cutting edge. However, the included angle formed by the V-shaped cutting edge is too large and, therefore, would not lend itself to use in forming a sharp notch in a blast hole.

BRIEF SUMMARY OF THE INVENTION

According to the present invention, a blast hole drill bit comprises an elongate body with opposing ends. One end is adapted to be attached to and driven by a blast hole drill and the other end has a face that extends foremost into the blast hole. This extension acts as a pilot to aid in starting the broach in the hole. The pilot also minimizes side to side drift within the hole.

This extension has a pilot diameter which extends rearwardly from said face to one or more grooving wings that extend radially outwardly from the pilot diameter on the bit.

Preferably, each grooving wing is formed by end milling a longitudinal recess along the outer periphery of the body so as to form a forwardly facing seat portion rearwardly of the pilot diameter. A wear resistant compact is then mounted in said seat and extends radially outwardly from said pilot diameter.

The seat portion is formed, preferably, on an enlarged section of the body so as to substantially support said wear resistant compact.

Preferably, a clearance angle is provided between the rearmost part of the grooving wing and the side of the grooved bore hole by tapering the wing radially inwardly as it extends from the pilot diameter. When viewed in side, preferably, that taper will be approximately 3 degrees when compared to the longitudinal axis of the body.

Preferably, when viewed in plan, the sides of the grooving wings converge in a radially outward direction so as to be V-shaped with the V-opening in the direction of the body.

According to the present invention, a hard wear resistant compact is provided for mounting on the wing of the grooving bit. The compact comprises a forward impact face and a side clearance face angularly related to, and extending rearwardly from, the forward clearance face. The side clearance face has a V-shaped configuration as viewed from the forward direction. It joins the forward impact face along a V-shaped cutting edge whose shape determines the shape of the notch formed in the blast hole. A side mounting face joins and extends rearwardly of said forward impact face and joins the side clearance face. The side clearance face and side mounting face terminate at a rear mounting face.

Preferably, the forward impact face has a V-shaped configuration which widens as it extends rearwardly.

Preferably, the side clearance face slopes inwardly of the compact as it extends rearwardly.

Preferably, the side clearance face forms an included angle of 2 to 10 degrees with a line extending parallel to the forward direction and, more preferably, 3 degrees.

Preferably, the V-shaped cutting edge forms an included angle of 45 to 100 degrees and, more preferably, 75 to 90 degrees.

Preferably, the compacts are made from a material having greater wear resistance than the body of the drill bit. Preferably, this material is a cemented hard metal carbide, such as tungsten carbide.

It is an object of the present invention to provide a drill bit that can efficiently drill longitudinal grooves in blast holes.

It is a further object of the present invention to provide a grooving bit for blast hole that is long lasting and resists wear.

It is a further object of the present invention to provide a rugged cutter bit with carbide compacts for the drilling of longitudinal grooves in blast holes.

It is also an object of this invention to provide hard wear resistant compacts for forming V-notches in blast holes.

BRIEF DESCRIPTION OF THE DRAWINGS

The above and other objects of this invention, and the exact nature of the present invention, will become more clearly apparent upon reference to the following detailed specification taken in connection with the accompanying drawings in which:

FIG. 1 is a view of a grooving bit according to the present invention.

FIG. 2 is a top plan view of the bit shown in FIG. 1 without the wear resistant compacts.

FIG. 3 is a top plan view of an alternate embodiment of the grooving bit according to the present invention.

DETAILED DESCRIPTION OF THE INVENTION

Figure 4:
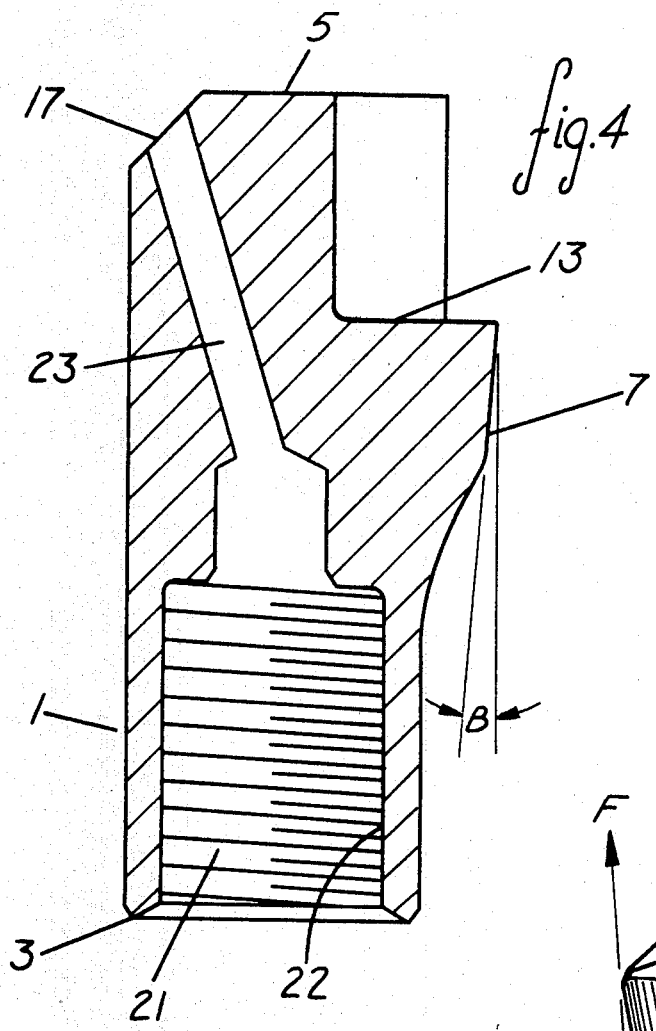
FIG. 4 is a longitudinal section through a grooving bit taken along line III—III shown in FIG. 2.

Referring to the drawings somewhat more in detail, shown in FIG. 1 is a blast hole drill bit 1 according to the present invention. It has an elongate body with a rear end 3 and an opposing forward end 5. The rear end 3 is adapted to be attached to a drill rod (not shown) and nonrotatably driven into a predrilled blast hole. The forward face 5 extends foremost into the blast hole and has a pilot diameter 9 which extends rearwardly from forward face 5. At the end of this pilot diameter is located one or more grooving wings 7 which extend radially outwardly from the pilot diameter 9. The grooving wings 7 are formed by longitudinal recesses 11 extending from the forward face 5 down the side of the pilot diameter 9 and radially extending seat 13 on which is located a hard and wear resistant compact 50.

The seat 13 extends transversely to the longitudinal axis of the drill bit 1. Mounted on the seat 13 and in the bottom of recess 11 is a compact 50 which extends radially outwardly from the pilot diameter 9.

Referring now to FIG. 2, which is a forward or top view of the drill bit shown in FIG. 1, except that the hard wear resistant compacts have been removed, it can be seen that two openings 17 are located in the forward face 5 of the pilot diameter 9. These openings communicate with a chamber in the lower portion of the drill bit 1 from which flushing fluid is driven under pressure out of the openings 17. The flushing fluid used may be a liquid or a gas, and is typically air.

As can be seen in FIG. 2, the seat portions 13 taper inwardly as they extend radially outwardly and are shown as being V-shaped in this figure with the V opening in the direction of the body of the drill bit. This V-shaped seat or grooving wing 13 forms an included angle A' which should have a value between 45 to 100 degrees and, more preferably, a value between 75 to 90 degrees.

The actual value of the angle A' used will depend upon the type of material which is being drilled through. The purpose of these seats 13 is to support the hard wear resistant compacts 50. The angle A' should match the included angle on the clearance face of the compact where the clearance face meets the rear face of the compact.

Shown in FIG. 3 is another top view of the drill bit 1. In this embodiment, there are three grooving wing seats 13. It is within the scope of this invention that one or more grooving wings may be placed on the drill bit. The number of grooving wings 7 used would be determined by the type of fracture pattern that is desired when blasting in the grooved hole. Each groove formed by the drill bit 1 acts as a stress riser such that when the pressure is suddenly increased in the hole due to the detonation of the blasting material, cracks will initiate at the tip of the V-notches that have been formed by the drill.

Shown in FIG. 4 is a longitudinal cross section of the drill bit shown in FIG. 2 taken along arrows III—III. It can be seen in FIG. 4 that the orifice 17 communicates between the forward face 5 of the drill bit 1 to a chamber 21 in the interior of the drill bit and located toward the rear end of the drill bit. The chamber communicates with the rear face 3 of the bit. The internal surface 22 of the chamber is threaded for attachment to a drill rod, not shown. Any of the other means known in the art for attaching a drill bit to a drill rod may be substituted for the threaded means shown.

Pressurized fluid is pumped up the hollow drill rod into the chamber 21 through passageway 23 and out the orifice 17 on the forward face. The pressurized fluid then flushes chips produced by the grooving action out the bottom of the blast hole.

It can also be seen in FIG. 4 that the grooving wing 7 extends farthest from the pilot diameter at its foremost end, that is, where the compact seat 13 is located. It then tapers inwardly and rearwardly at an angle B which should be between 2 to 10 degrees, preferably, approximately 3 degrees. The actual value used should be equivalent to or greater than the clearance angle on the hard wear resistant compact that is mounted on the seat 13 of the bit.

Figure 5:
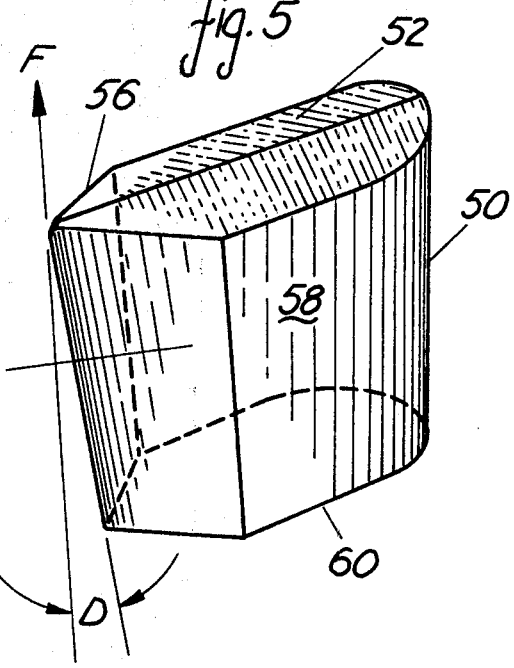
FIG. 5 is a wear resistant compact according to the present invention.

Shown in FIG. 5 is a hard wear resistant compact that is designed to be mounted by brazing or other means on the periphery of a grooving bit such as those shown in the preceding figures. The compact 50 has a forward impact face 52, a side clearance face 54, which is angularly related to and extends rearwardly from the forward clearance face 52. This side clearance face has a V-shaped configuration, as viewed from the forward direction. This is most clearly shown in FIG. 6. There is a V-shaped cutting edge 56 which forms the juncture between the forward impact face 52 and the side clearance face 54. A side mounting face 58 joins and extends rearwardly from the forward impact face 52 and also joins the side clearance face 54. Rearmost on the compact 50 is a rear mounting face 60 which joins the side clearance face and the side mounting face.

As can be seen in FIG. 5, the side clearance face 54 slopes inwardly as the compact extends rearwardly, the arrow F showing the direction of forward movement when the compact is appropriately mounted on the grooving bit seat 13. This clearance face 54 forms an included angle with the forward direction or longitudinal axis of the bit, shown in the FIG. 5 as angle D. It is preferred that this angle be between 2 to 10 degrees, and most preferably, it should be 3 degrees. This clearance angle serves to allow chips to be flushed out of the hole and also serves to reduce jam ups as the bit is being withdrawn from the grooved hole.

Figure 6:
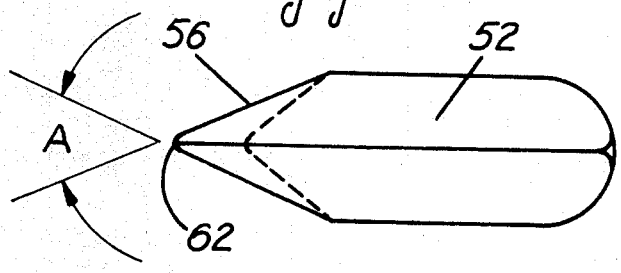
FIG. 6 is a top view of the wear resistant compact shown in FIG. 5.

Shown in FIG. 6 is a top view of the compact shown in FIG. 5. The impact face 52 is shown and the cutting edge 56 is also shown. It can be seen that the cutting edge is V-shaped and it forms an included angle A which should be between 45 to 100 degrees, and most preferably, 75 to 90 degrees.

While it is desirable that this angle A be as sharp and acute as possible, the greater the sharpness of the angle, the faster and more prone the cutting edge will be to wearing out by chipping. However, the angle should not be so large so as to produce a notch which will not act as a crack initiation cite. In addition, chipping may also be alleviated by placing a radiused peak 62 rather than a sharp peak on the cutting edge; but, again, the radius should not be so large as to cause the root of the notch produced to fail in its function as a crack initiation site.

As shown in both FIGS. 5 and 6, the forward impact face 52 has a V-shaped configuration which widens as it extends rearwardly. However, other configurations are possible for this face and some are shown in FIGS. 7 and 8.

Figure 7:
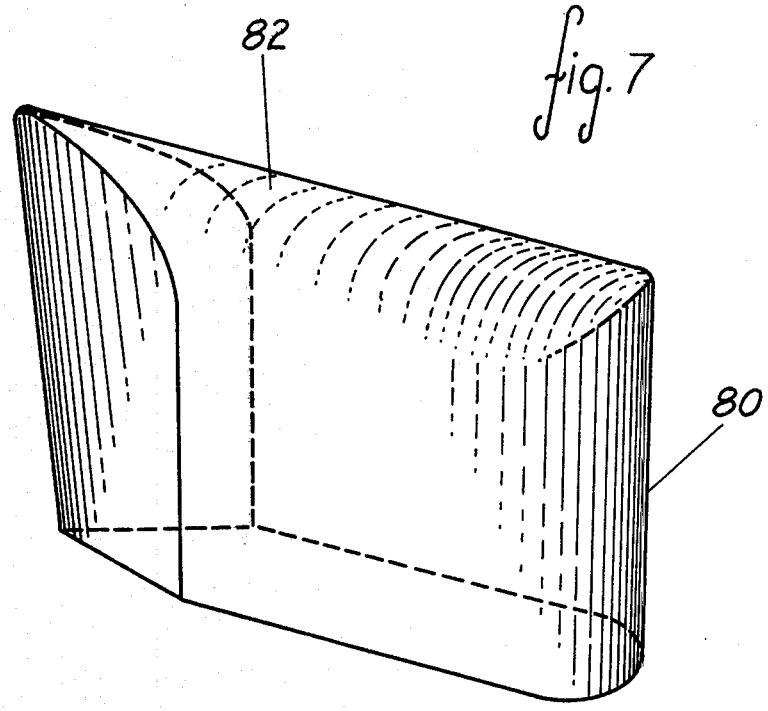
FIG. 7 is an alternative embodiment of a wear resistant compact according to the present invention.

FIG. 7 shows a compact 80 having a forward impact face 82 which is convex.

Figure 9:
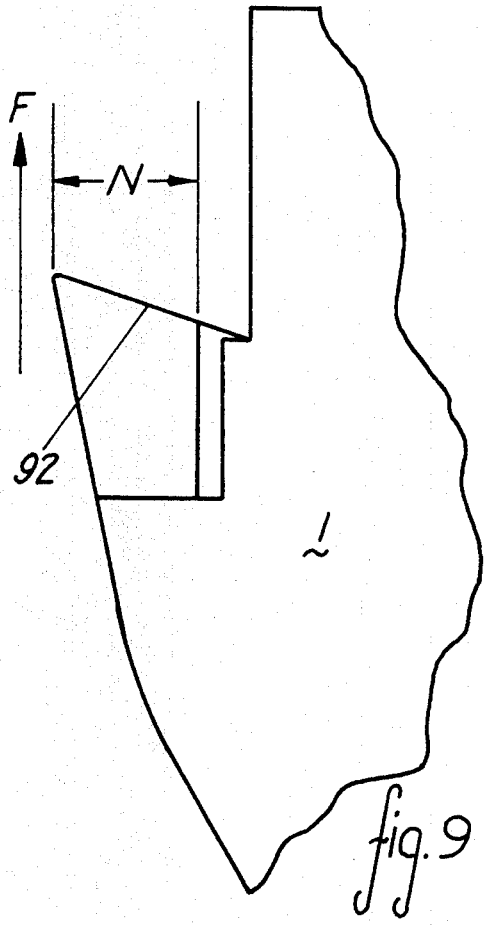
FIG. 9 shows a partial side view of a drill according to the present invention having a wear compact as shown in FIG. 8.
Figure 8:
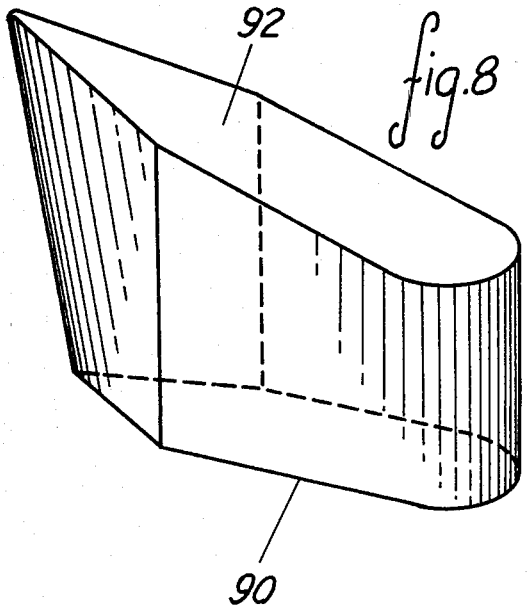
FIG. 8 is another alternative embodiment of the present invention.

FIG. 8 shows a compact 90 which has a flat forward impact face 92. This impact face 92 slopes rearwardly as it extends inwardly of the grooving bit body 1, as shown in FIGS. 8 and 9.

The depth N of the V of the compacts shown in FIGS. 5, 6, 7 and 8 is most preferably approximately one-fourth inch. Grooves of this depth with the values of the angle A which have been previously mentioned should produce adequate stress risers in most blasting hole applications.

Modifications may be made within the scope of the appended claims.

What is claimed is:

1. A blast hole drill bit which comprises an elongate body with opposing ends with one end adapted to be attached and driven by a drill and the other end having a face that extends foremost into the hole, a pilot diameter extending rearwardly from said face, and a grooving wing extending radially outwardly from said pilot diameter, said grooving wing comprising a recess formed longitudinally from said forward face rearwardly in said body and ending in a seat that is transverse to the longitudinal axis of said body, and a wear compact mounted on said seat and in said recess and extending radially outwardly from said pilot diameter.

2. A blast hole drill bit according to claim 1 which further comprises the outermost peripheral surfaces of said grooving wing when viewed in side tapering inwardly rearwardly of said pilot diameter.

3. A blast hole drill bit according to claim 2 in which said grooving wing, when viewed in plan, tapers inwardly as it extends radially outwardly.

4. A blast hole drill bit according to claim 2 in which said outermost peripheral surface forms an included angle of approximately 3 degrees with the longitudinal axis of said body.

5. A blast hole drill bit according to claim 3 in which said grooving wing is V-shaped with the V opening in the direction of said body.

6. A blast hole drill bit according to claim 2 in which said grooving wing is V-shaped with the V opening in the direction of said body.

7. A blast hole drill bit according to claim 1 in which said elongate body has an enlarged peripheral section rearwardly of said pilot diameter and said seat is formed facing forwardly on said enlarged peripheral section.

8. A blast hole drill bit according to claim 1 in which said wear compact is formed of a cemented hard metal carbide.

9. A blast hole drill bit according to claim 7 in which said wear compact is formed of a cemented hard metal carbide.

10. A blast hole drill bit according to claims 5 or 6 wherein said V-shaped grooving wing defines an included angle A′ having a value of 45 to 100 degrees.

11. A blast hole drill bit according to claim 10 wherein said angle A′ is 75 to 90 degrees.

12. A hard wear resistant compact designed to be mounted on the periphery of a grooving bit which is to be nonrotatably driven in a blast hole so as to form a V-shaped notch in the wall of a blast hole, said compact comprising: a forward impact face; a side clearance face angularly related to, and extending rearwardly from, said forward impact face; said side clearance face having a V-shaped configuration as viewed from a forward direction; a cutting edge which determines the shape of the notch, and forms a juncture between said forward impact face and said side clearance face; a side mounting face adjacent said side clearance face, joining and extending rearwardly from said forward impact face and joining said side clearance face; and a rear mounting face joining portions of said side clearance face and said side mounting face.

13. A compact according to claim 12 wherein said forward impact face has a V-shaped configuration which widens as it extends rearwardly.

14. A compact according to claim 13 wherein said side clearance face slopes inwardly of the compact as it extends rearwardly.

15. A compact according to claim 14 wherein said clearance face forms an included angle of 2 to 10 degrees with a line extending parallel to the forward direction.

16. A compact according to claim 14 wherein said included angle formed by said clearance face with a line extending parallel to the forward direction is 3 degrees.

17. A compact according to claim 12 wherein said V-shaped cutting edge forms an included angle A of 45 to 100 degrees.

18. A compact according to claim 17 wherein said angle A is between 75 and 90 degrees.

19. A compact according to claims 12, 17 or 18 wherein said V-shaped cutting edge has a rounded peak.

* * * * *